United States Patent [19]

Bisson

[11] Patent Number: 4,719,863

[45] Date of Patent: Jan. 19, 1988

[54] SMALL CLOTH VISE FOR A SEWING MACHINE

[75] Inventor: Flavio Bisson, Cava Manara Pv, Italy

[73] Assignee: Necchi Societa per Azioni, Pavia, Italy

[21] Appl. No.: 42,840

[22] Filed: Apr. 27, 1987

[30] Foreign Application Priority Data

May 14, 1986 [IT] Italy ..... 32306/86[U]

[51] Int. Cl.[4] ..... D05B 21/00

[52] U.S. Cl. ..... 112/121.12; 112/104; 112/121.15

[58] Field of Search ..... 112/121.12, 121.15, 112/121.11, 104, 113, 147

[56] References Cited

U.S. PATENT DOCUMENTS 3,483,834 12/1969 Bennison ..... 112/121.15
3,528,378 9/1970 Westhoff et al. ..... 112/121.15
4,463,697 7/1984 Vogt et al. ..... 112/121.15 X
4,574,717 3/1986 Junemann et al. ..... 112/121.12
4,589,359 5/1986 Scholl ..... 112/104 X

*Primary Examiner*—H. Hampton Hunter
*Attorney, Agent, or Firm*—Stevens, Davis, Miller & Mosher

[57] ABSTRACT

A small cloth vise in a sewing machine arranged for the automatic application of small pockets applied on blue-jeans or on other similar garments by two fixing seams where at least on one side the seams are not parallel, comprising a central element, a cylinder fixed to the element, a small plate which transmits motion driven by the cylinder, a first blade placed under the central element for displacement in proximity to the seams operatively connected to the small plate, and first and second levers having ends connected to the blade corresponding to the side where the seams are not parallel, the first lever effecting a displacement larger than that of the second lever for causing the blade to rotate and thus to translate in sequence.

4 Claims, 3 Drawing Figures

FIG. 2
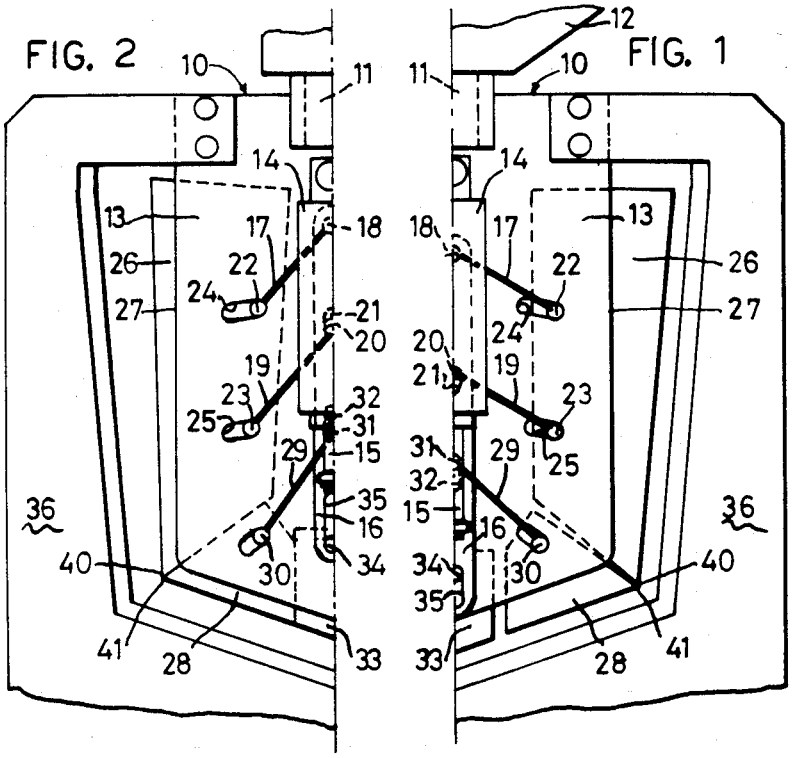
FIG. 1
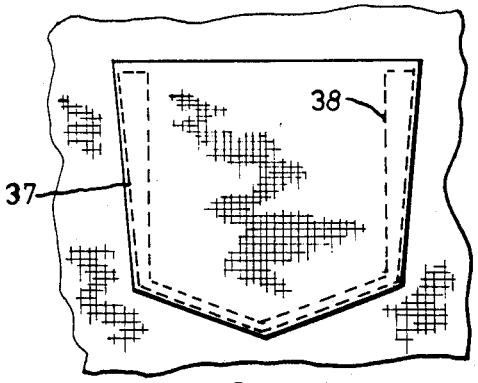
FIG. 3

SMALL CLOTH VISE FOR A SEWING MACHINE

The present invention relates to a small cloth vise for a sewing machine arranged for automatically applying small pockets on blue-jeans or on other similar garments by two fixing seams where at least on one side the seams are not parallel.

BACKGROUND OF THE INVENTION

In sewing machines for automatically applying small pockets on blue-jeans or on the front of shirts, after the small pocket has been automatically folded, a small cloth vise holds the small pocket on the garment and a plate, in which the outline of the small pocket is made out, presses the garment near the small cloth vise while translating together with the small cloth vise automatically along a predetermined path for executing the seam.

The seaming takes place near the outline of the plate of the small cloth vise which holds the pocket on the garment. In the case of a single seam, there is no difficulty in holding the pocket material to be applied since the seam is made very close to the outer edge of the plate of the small cloth vise. When two parallel seams are to be made, the plate of the small cloth vise is formed from a predetermined number of blades, according to the outline of the pocket, running parallel along the edges of the vise and capable of deviating toward the inside and outside of the vise so that the seaming always takes place in proximity to the blades. In forming the plate of the vise from blades, it is necessary to avoid an interruption of the outline in proximity, to the angles to be sewn since at such points there is a change of direction in the work feeding and as a consequence there are less opportunities to obtain a perfect quality seam as the fabric at said angles may get deformed.

Fashion evolves continuously and the clothing industry has to fit in. The current fashion imposes the application of pockets with two fixing seams where at least on one side the seams are not parallel. With this conformation of the two seams, the same above exposed problems become apparent. Heretofore, the fixing of the pocket by sewing two parallel seams has been used, but it is not possible to solve such problems by a simple translation of the blades.

SUMMARY OF THE INVENTION

It is an object of the present invention to provide a vise overcoming the above described drawbacks.

The techinical problem to be solved was the realization of a small cloth vise having a variably shaped outline for obtaining non-parallel seams.

The solution of the technical problem is characterized by a small plate, when it is operated, displacing a first and a second lever connected to the blade corresponding to the side where the seams are not parallel, the first lever effecting a displacement larger than that of the second lever for causing the blade to rotate and thus to translate in sequence.

BRIEF DESCRIPTION OF DRAWINGS

Other details and features of the invention will stand out from the description given below by way of non-limitative example and with reference to the accompanying drawings in which:

FIG. 1 is a view of half of the vise in an operating condition.

FIG. 2 is a view of a symmetrical other half of the vise in a different operating position.

FIG. 3 represents the course of the two non-parallel holding seams of the pocket on the garment.

DESCRIPTION OF THE PREPARED EMBODIMENT

With reference to FIGS. 1 and 2, a small cloth vise 10 pivots in element 11 at an arm 12 of an element, not shown, which controls the raising, lowering and translation of the vise 10.

Vice 10 comprises a central element 13 on which a pneumatic cylinder 14 is fixed. To the end of a stem 15 of cylinder 14, a small plate 16 is fixedly connected, which is placed displaceably on element 13.

A first lever 17 is pivotally mounted on a pin 18 fixed to the small plate 16. A second lever 19 cooperates with the small plate 16 by means of a pin 20 which engages a slot 21 in small plate 16.

Levers 17 and 19, schematically illustrated in FIGS. 1 and 2 are pivoted at the other end at pins 22 and 23, respectively, which run in corresponding slots 24 and 25 in central element 13 of the vise 10. The slot 24 is longer than slot 25 for purposes hereinafter illustrated. At the inferior ends of the pins 22 and 23 there is fixed a first blade 26 placed under the central element 13 along a lateral wall 27. A second blade 28, placed under the central element 13, is connected to the small plate 16 by means of a third lever 29 pivoted at one end to pin 30 mounted on blade 28. The other end of the lever 29 is fixed to a pin 31 coupling with a slot 32 in small plate 16. A third blade 33, placed under the central element 13 toward the lower portion of the vise 10, is guided by and is connected to the small plate 16 by means of a pin 34 fixed to blades 33 and coupled with a longitudinal slot 35 in small plate 16.

The pocket which is to be sewn to the garment, after the edge folding operation, is brought in contact with the fabric on which it is to be sewn and held in this position by the vise 10 by means of its blades 26, 28 and 33 which are in their position illustrated in FIG. 1 very close to the plate 36 which presses the fabric. In this position of the blades 26, 28 and 33 the more exterior seam 37 (FIG. 3) is executed. The corner 40 of the blade 26 is in contact with the corner 41 of the blade 28 so as to assure continuity of the outline in proximity of the angle where there is a change in the fabric feeding direction.

At the end of sewing of the seam 37 the pneumatic cylinder 14 is automatically operated, the stem 15 of which, from the position illustrated in FIG. 1 is displaced upwardly a predetermined quantity to the position illustrated in FIG. 2. This displacement of the stem 15 is transmitted to the small plate 16, solidal to it, which displaces in sequence the levers 17, 19 and 29 and as a consequence the pins 22, 23 and 30 along the corresponding slots toward the inner part of the element 13.

When small plate 16 is moved by pneumatic cylinder 14, first lever 17 carries out a displacement greater than the displacement of the second lever 19 because pin 18, fixed to small plate 16 and connected by first lever 17 to pin 22, runs in slot 24 which is longer than slot 25 in which runs pin 23 connected by second lever 19 to pin 20 engaged in slot 21 of small plate 16. Therefore, by the displacement a rotation and thus a translation of the blades 26 are obtained in sequence. With the rotation and the translation of the blades 26 the corner 40 of the blades 26 still stays in contact with the corner 41 of the blade 28.

The outline of the vise 10 is now reduced in such a way as to permit accomplishing the sewing of the seam 38 on the pocket with the same sewing operating conditions as was utilized on the exterior seam 37. The sewing machine needle works in both the seams on the fabric in proximity of the holding elements of the cloth. The described example refers to the application of a pocket with two fixing seams where two symmetrical sides of the seams are not parallel. The invention however, may be applied even if the non-parallel seams are executed on one side only. For obtaining this, it is sufficient that the sequence of rotation an translation be applied to only one series of blades.

What is claimed is:

1. A small cloth vise in a sewing machine arranged for the automatic application of small pockets applied on blue-jeans or on other similar garments by two fixing seams where at least on one side said seams are not parallel, comprising a central element, a cylinder fixed to said element, a small plate which transmits motion driven by said cylinder, a first blade placed under said central element for displacement in proximity to the seams operatively connected to said small plate, and first and second levers having ends connected to said blade corresponding to the side where said seams are not parallel, said first lever effecting a displacement larger than that of said second lever for causing said blade to rotate and thus to translate in sequence.

2. The small cloth vise according to claim 1, including a first pin fixed to said small plate and pivotally connected to an end of said first lever, a second pin fixed to said blade and pivotally connected to another end of said first lever, a third pin fixed to an end of said second lever and a fourth pin fixed to said blade and pivotally connected to another end of said second lever, said central element defining first and second slots therein into which slide said second and fourth pins, respectively, said small plate defining a first slot therein into which slides said third pin, said first slot of said central element being of greater length than said second slot of said central element.

3. The small cloth vise according to claim 2 including a second blade, a fifth pin fixed to said second blade, a third lever pivotally connected at an end to said fifth pin and a sixth pin fixed to another end of said third lever, said small plate defining a second slot into which slides said sixth pin whereby movement of said small plate effects displacement of said second blade.

4. The small cloth vise according to claim 3 including a third blade and a seventh pin fixed to said third blade, said small plate defining a third slot into which slides said seventh pin whereby movement of said small plate effects displacement of said third blade.

* * * * *